US009914205B2

(12) United States Patent
Chen et al.

(10) Patent No.: US 9,914,205 B2
(45) Date of Patent: Mar. 13, 2018

(54) AUXILIARY HANDLE AND ELECTRIC TOOL HAVING THE SAME

(71) Applicant: CHERVON INTELLECTUAL PROPERTY LIMITED, Road Town (VG)

(72) Inventors: Cuihua Chen, Nanjing (CN); Shubin Tong, Nanjing (CN)

(73) Assignee: Chervon (HK) Limited, Wanchai (HK)

( * ) Notice: Subject to any disclaimer, the term of this patent is extended or adjusted under 35 U.S.C. 154(b) by 617 days.

(21) Appl. No.: 14/518,099

(22) Filed: Oct. 20, 2014

(65) Prior Publication Data

US 2015/0107865 A1 Apr. 23, 2015

(30) Foreign Application Priority Data

Oct. 23, 2013 (CN) ..... 2013 2 0657477 U

(51) Int. Cl.
*B25F 5/02* (2006.01)
*B25D 17/04* (2006.01)

(52) U.S. Cl.
CPC ..... *B25F 5/026* (2013.01); *B25D 17/04* (2013.01); *B25F 5/024* (2013.01)

(58) Field of Classification Search
CPC . B25F 5/02; B25F 5/024; B25F 5/026; B25D 17/04
USPC ..... 173/162.1, 162.2; 16/110.1, 422, 426, 16/430
See application file for complete search history.

(56) References Cited

U.S. PATENT DOCUMENTS 8,132,296 B2 * 3/2012 Di Nicolantonio ..... B25F 5/026 16/426
8,256,528 B2 * 9/2012 Oesterle ..... B25F 5/006 173/162.1
8,407,860 B2 * 4/2013 Brennenstuhl ..... B25F 5/026 16/422
8,914,947 B2 * 12/2014 Weiss ..... B25D 17/043 16/426
9,180,586 B2 * 11/2015 Nemetz ..... B25D 17/043
2011/0011609 A1 * 1/2011 Simm ..... B25D 17/04 173/171
2011/0120741 A1 * 5/2011 Limberg ..... B25F 5/026 173/170
2012/0312572 A1 * 12/2012 Nemetz ..... B25D 17/043 173/162.2
2014/0251649 A1 * 9/2014 Kondo ..... B23Q 9/00 173/170
2014/0251650 A1 * 9/2014 Kondo ..... B25F 5/02 173/171
2015/0174753 A1 * 6/2015 Kamiya ..... B25F 5/008 173/170

* cited by examiner

*Primary Examiner* — Gloria R Weeks
*Assistant Examiner* — William A Weller
(74) *Attorney, Agent, or Firm* — Greenberg Traurig, LLP

(57) ABSTRACT

An auxiliary handle for removable connection with a housing of an electric tool having a first engaging portion, a second engaging portion and a third engaging portion. The auxiliary handle includes a handling portion, a fixing portion and a locking portion. The handling portion enables the user to handle the auxiliary handle and operate the locking portion. The fixing portion is engaged with the first engaging portion and the second engaging portion so as to connect the auxiliary handle to the housing. The locking portion interacts with the third engaging portion so as to lock the auxiliary handle.

8 Claims, 6 Drawing Sheets

AUXILIARY HANDLE AND ELECTRIC TOOL HAVING THE SAME

RELATED APPLICATION INFORMATION

This application claims the benefit of CN 201320657477.8, filed on Oct. 23, 2013, the disclosure of which is incorporated herein by reference in its entirety.

FIELD OF THE DISCLOSURE

The subject disclosure relates to an auxiliary handle, and more particularly to an auxiliary handle for an electric tool and an electric tool comprising the auxiliary handle.

BACKGROUND

Electric tools, such as a drill or an electrical hammer, usually have a main handle which may be operated by the user with one hand. However, when such tools work, a relatively large impact will act on the hand, and it is hard to meet the operating requirements just with one hand holding the tool. In particular, when a high torque or a large force output is needed, an auxiliary handle is generally provided to increase the handling stability and meet the operating requirements, to ensure the safety of the user and to reduce the risk of possible damage.

At present, the auxiliary handle and the tool are connected by a sleeve or thread connection. The sleeve connection needs to pass through the head portion of the housing, thus the operation is inconvenient and needs to take up the axial space of the housing so that the axial size of the whole tool may be increased. The thread connection is not stable since there is only one connection point between the auxiliary handle and the tool.

SUMMARY

In view of the above, it is desired to provide an auxiliary handle for an electric tool and an electric tool comprising the auxiliary handle, which can be operated simply, save space and ensure a reliable connection.

The subject disclosure presents an auxiliary handle for an electric tool, the electric tool comprising a housing having a first engaging portion, a second engaging portion and a third engaging portion, wherein the auxiliary handle is removably fixed on the housing and comprises a handling portion, a fixing portion and a locking portion, and the handling portion enables the user to handle the auxiliary handle and operate the locking portion, wherein the fixing portion can be engaged with the first engaging portion and the second engaging portion so as to connect the auxiliary handle to the housing, and the locking portion can interact with the third engaging portion so as to lock the auxiliary handle.

The housing has a longitudinal axis, and the first engaging portion and the second engaging portion may be distributed circumferentially around the longitudinal axis, wherein the auxiliary handle can be engaged with the first engaging portion and the second engaging portion in a direction substantially perpendicular to the longitudinal axis, and the first engaging portion and the second engaging portion may be several grooves formed on the housing, the grooves being distributed uniformly and circumferentially around the longitudinal axis.

The locking portion may comprise an actuating member fixedly connected to the handling portion and a locking member at least partially accommodated in the fixing portion, and the handling portion may be operated so that the actuating member acts on the locking member and a pressure is generated between the locking member and the third engaging portion of the housing to lock the fixing portion and the housing.

The actuating member may be rod-shaped and the locking member may be a steel ball, and the fixing portion may be generally U-shaped and have a main extending axis and two clamping members extending generally perpendicular to the main extending axis, the clamping members being engaged with the first engaging portion and the second engaging portion of the housing respectively, the fixing portion having a hole along the main extending axis and a groove facing the housing and communicated with the hole, the locking member being accommodated in the groove and partially protruding from the groove, and the actuating member with one end thereof fixedly connected to the handling portion and the other end accommodated in the hole.

The hole may be at least partially provided with internal threads and the actuating member may be provided with external threads for engaging with the internal threads and a circumferential inclined surface for interacting with the locking member.

The housing has a longitudinal axis, and the fixing portion may be generally U-shaped and have a main extending axis and two clamping members extending generally perpendicular to the main extending axis, the clamping members being engaged with the first engaging portion and the second engaging portion of the housing respectively, the fixing portion being provided at its center with a threaded hole having a central axis perpendicular to the longitudinal axis and the main extending axis, and the locking portion comprising an actuating member having one end fixedly connected to the handling portion and the other end provided with external threads for engaging with the threaded hole.

The third engaging portion may be arranged between the first engaging portion and the second engaging portion may be a part of the housing or a boss arranged on the housing, wherein the boss is formed by a material having high wear resistance and has an inner surface for engaging with one end of the actuating member.

The subject disclosure further presents an electric tool, comprising a housing, a motor arranged in the housing, a transmission mechanism driven by the motor, a working head driven by the transmission mechanism, a main handle extending from the housing and an auxiliary handle removably fixed on the housing and comprising a handling portion, a fixing portion and a locking portion, the handling portion enabling the user to handle the auxiliary handle and operate the locking portion, wherein the housing has a first engaging portion, a second engaging portion and a third engaging portion arranged between the first engaging portion and the second engaging portion, wherein the fixing portion can be engaged with the first engaging portion and the second engaging portion so as to connect the auxiliary handle to the housing, and the locking portion can interact with the third engaging portion so as to lock the auxiliary handle.

The housing has a longitudinal axis, and the first engaging portion and the second engaging portion may be distributed circumferentially around the longitudinal axis, wherein the auxiliary handle can be engaged with the first engaging portion and the second engaging portion in a direction substantially perpendicular to the longitudinal axis, and the first engaging portion and the second engaging portion may be several grooves formed on the housing, the grooves being distributed uniformly and circumferentially around the longitudinal axis.

The locking portion may comprise an actuating member fixedly connected to the handling portion and a locking member may be at least partially accommodated in the fixing portion, and the handling portion may be operated so that the actuating member acts on the locking member and a pressure is generated between the locking member and the third engaging portion of the housing to lock the fixing portion and the housing.

The actuating member may be rod-shaped and the locking member may be a steel ball, and the fixing portion may be generally U-shaped and have a main extending axis and two clamping members extending generally perpendicular to the main extending axis, the clamping members being engaged with the first engaging portion and the second engaging portion of the housing respectively, the fixing portion having a hole along the main extending axis and a groove facing the housing and communicated with the hole, the locking member being accommodated in the groove and partially protruding from the groove, and the actuating member having one end fixedly connected to the handling portion and the other end accommodated in the hole.

The housing has a longitudinal axis, and the fixing portion may be generally U-shaped and have a main extending axis and two clamping members extending generally perpendicular to the main extending axis, the clamping members being engaged with the first engaging portion and the second engaging portion of the housing respectively, the fixing portion being provided at its center with a threaded hole having a central axis perpendicular to the longitudinal axis and the main extending axis, and the locking portion comprising an actuating member having one end fixedly connected to the handling portion and the other end provided with external threads for engaging with the threaded hole.

For the auxiliary handle for electric tool, the fixing portion is preferably engaged with the first engaging portion and the second engaging portion distributed circumferentially around the longitudinal axis of the housing, thus the connection is reliable. The auxiliary handle only encircles a portion of the circumference of the housing, and does not need to pass through the head portion of the housing, thereby reducing the axial size of the whole tool. The locking portion may be engaged with the third engaging portion so as to lock the auxiliary handle by operating the handling portion, thus the operation is simple. Moreover, the first engaging portion and the second engaging portion may be arranged on any position in the circumferential direction and have a plurality of positions, thus the user may fix the auxiliary handle on desired positions according to the specific requirements.

DETAILED DESCRIPTION

Figure 1:
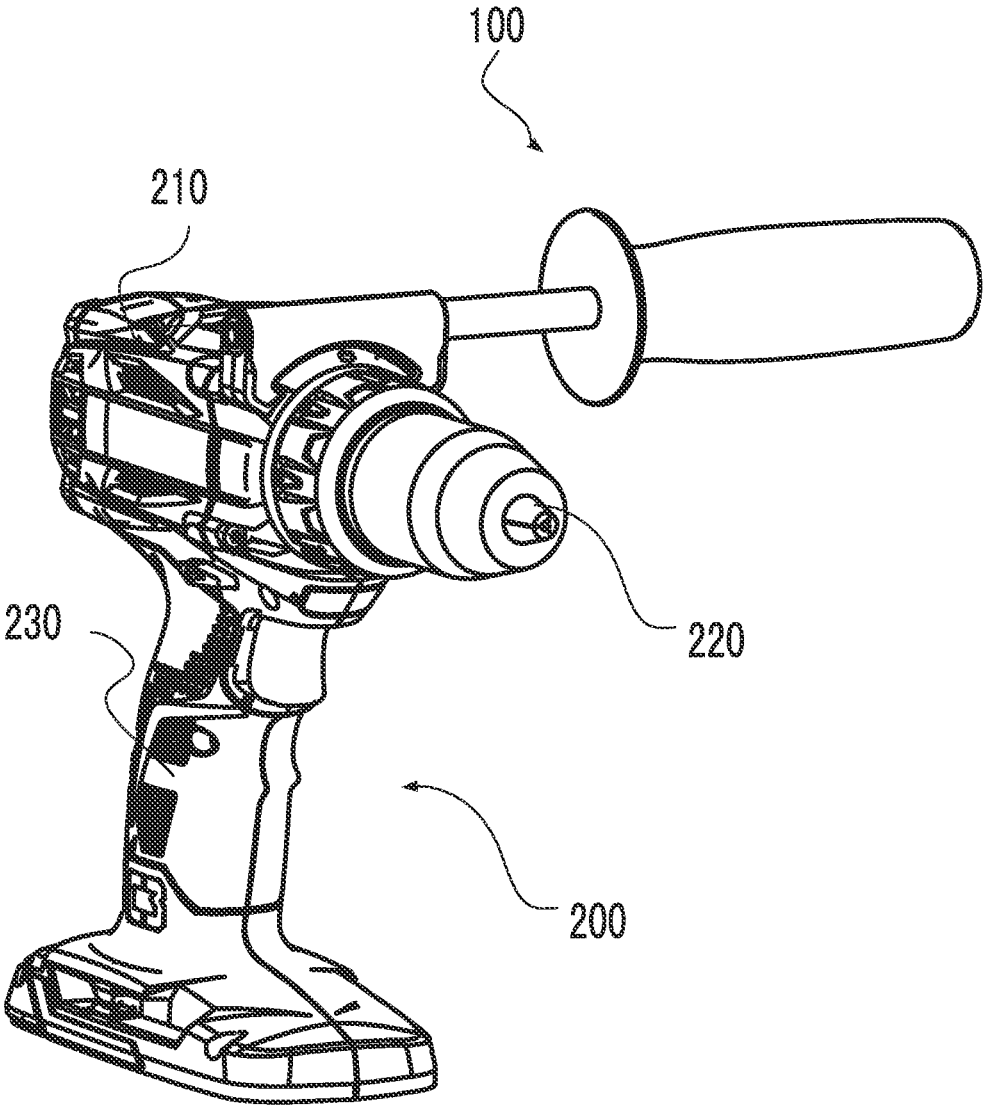
FIG. 1 is a schematic view showing an exemplary connection between an auxiliary handle and an electric tool according to the description which follows.

Referring to FIG. 1, an auxiliary handle 100 is removably connected to an electric tool 200 for providing an auxiliary handling portion to the user. In the illustration, the electric tool 200 is a drill. It may be appreciated that the electric tool 200 may also be any other electric tools which can use an auxiliary handle, such as an electrical hammer, an angle grinder, and so on. The electric tool 200 comprises a housing 210, a motor arranged in the housing 210, a transmission mechanism driven by the motor, a working head 220 driven by the transmission mechanism and a main handle 230 extending from the housing 210. The auxiliary handle 100 is removably fixed on the front end of the housing 210 adjacent to the working head 220. It may be appreciated that the auxiliary handle 100 may also be fixed on other positions of the housing 210.

Figure 2:
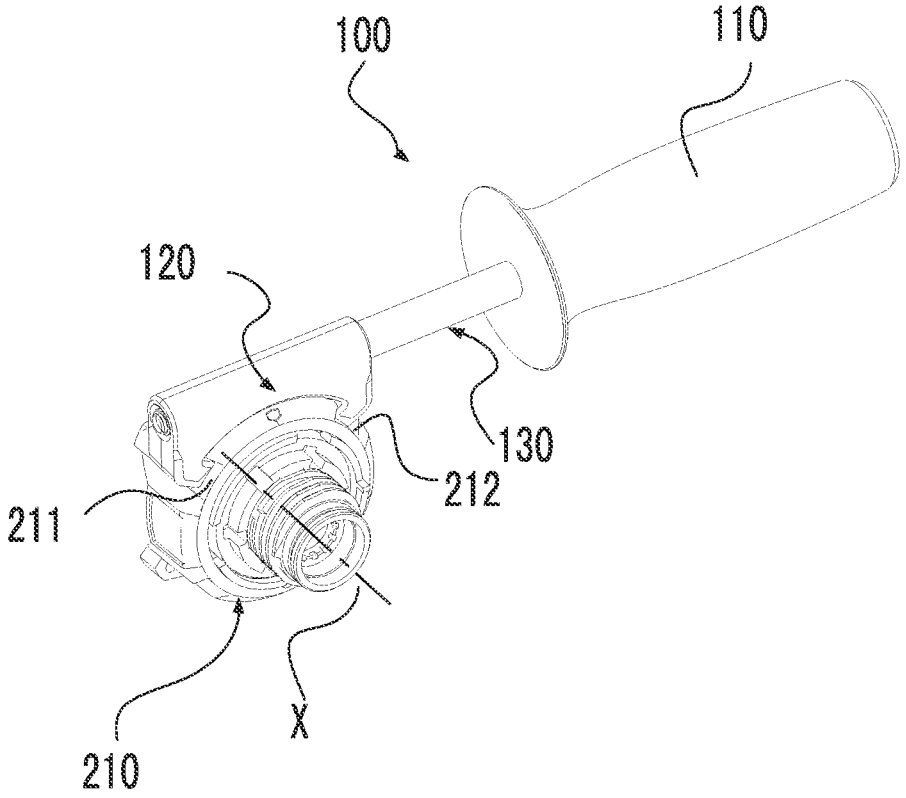
FIG. 2 is a schematic view showing a connection between the auxiliary handle and a housing of the electric tool of FIG. 1.

The connection structure between the auxiliary handle 100 and the housing 210 will be described hereinafter. Referring to FIG. 2, the housing 210 has a longitudinal axis X, a first engaging portion 211 and a second engaging portion 212 arranged circumferentially around the longitudinal axis X. The auxiliary handle 100 is engaged with the first engaging portion 211 and the second engaging portion 212 in a direction that is substantially perpendicular to the longitudinal axis X, thus the connection may be more reliable. The first engaging portion 211 and the second engaging portion 212 are grooves in the housing 210, and preferably are formed integrally with the housing 210. The first engaging portion 211 and the second engaging portion 212 may be arranged on any position in the circumferential direction, and preferably are uniformly distributed in the circumferential direction, or may also have a plurality of positions, thus the user may fix the auxiliary handle 100 on a desired position according to the actual requirements. It may be appreciated that the first engaging portion 211 and the second engaging portion 212 may also be arranged on a separated housing part connected to the housing 210. Preferably, the housing part may be formed by metal in order to increase the connection strength. In should be appreciated that the housing part is a part of the housing 210. The auxiliary handle 100 comprises a handling portion 110, a fixing portion 120 and a locking portion 130. The handling portion 110 is configured for the user to handle the auxiliary handle 100 and operate the locking portion 130. The fixing portion 120 is engaged with the first engaging portion 211 and the second engaging portion 212 to connect the auxiliary handle 100 to the housing 210. The locking portion 130 is used for locking the fixing portion 120 with the housing 210 or disengaging the fixing portion 120 from the housing 210.

Figure 3:
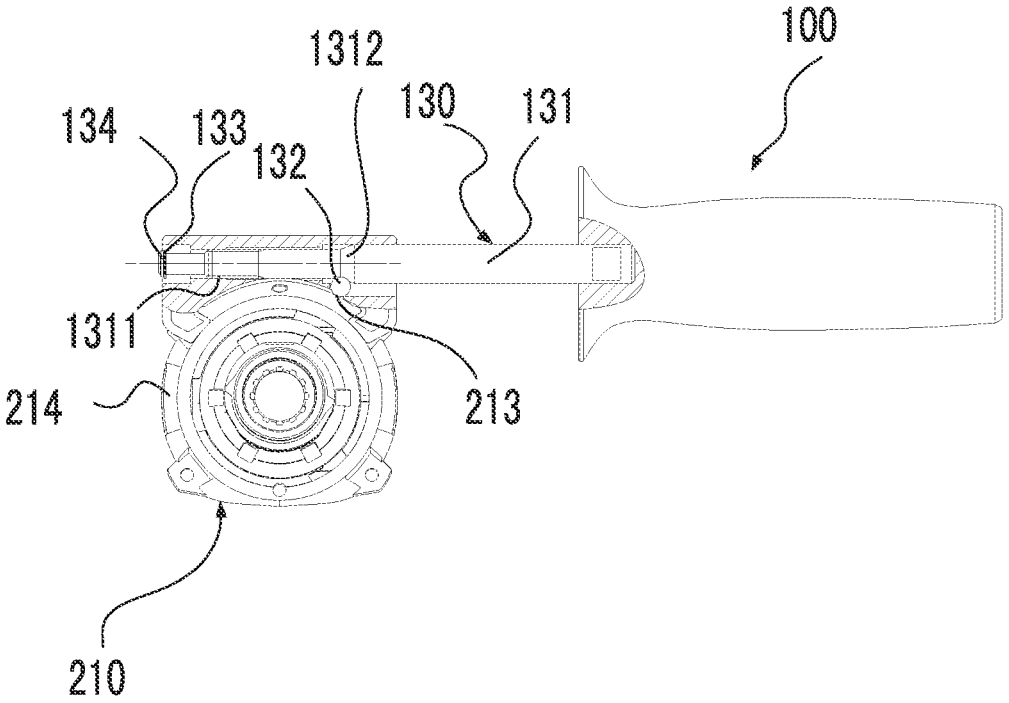
FIG. 3 is a partial sectional view of FIG. 2.
Figure 4:
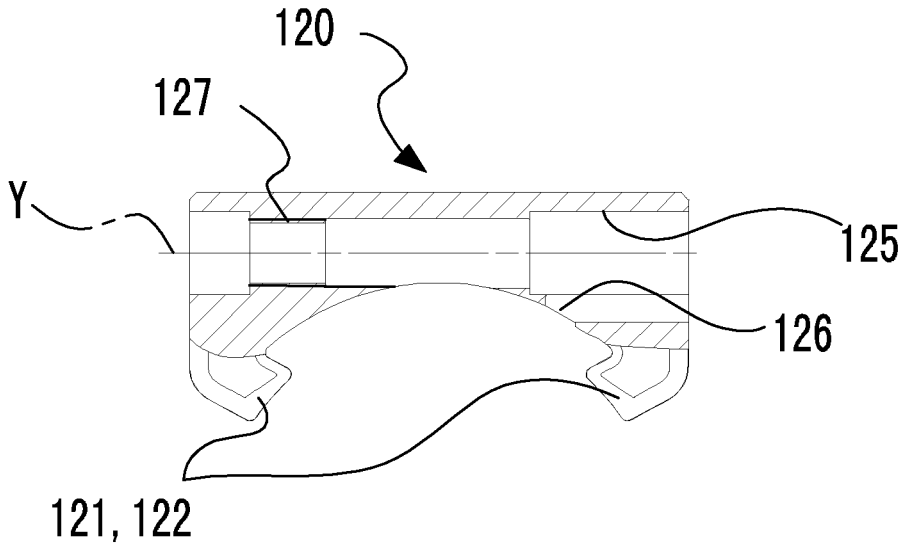
FIG. 4 is a schematic view of a fixing portion of the auxiliary handle of FIG. 1.

Referring to FIGS. 3-4, the housing 210 has a third engaging portion 213 located between the first engaging portion 211 and the second engaging portion 212. The locking portion 130 interacts with the third engaging portion 213 so as to lock the auxiliary handle 100. It may be appreciated that the third engaging portion 213 may also be arranged on any other position of the housing. The fixing portion 120 is generally U-shaped, and has a main extending axis Y and two clamping members 121, 122 extending generally perpendicular to the main extending axis Y. The clamping members 121 and 122 are configured to engage with the first engaging portion 211 and the second engaging portion 212 of the housing 210, respectively. When connected to the housing 210, the clamping members 121, 122 and the main extending axis Y are perpendicular to the longitudinal axis X. The clamping members 121 and 122 are integrally formed with the fixing portion 120. It may be appreciated that the clamping members 121 and 122 may also be separated members connected to the fixing portion 120. The fixing portion 120 may be slid in the direction of the longitudinal axis X to enable the clamping members 121 and 122 to engage with the first engaging portion 211 and the second engaging portion 212, respectively. At that moment, a space still exists between the clamping members 121, 122 and the first and second engaging portions 211, 212, and the auxiliary handle 100 can move relative to the housing 210. The number of the grooves of the first engaging portion 211 and the second engaging portion 212 may be four, and the clamping members 121 and 122 are engaged with the adjacent grooves respectively. A projection 214 is formed between the adjacent grooves. The projection 214 partially extends beyond the grooves so as to prevent the auxiliary handle 100 from radially disengaging from the housing 210.

The locking portion 130 comprises an actuating member 131 fixedly connected to the handling portion 110 and a locking member 132 at least partially accommodated in the fixing portion 120. The actuating member 131 is rod-shaped, and the locking member 132 is a steel ball. The fixing portion 120 has a hole 125 along the main extending axis Y and a groove 126 facing the housing. The groove 126 is communicated with the hole 125. The locking member 132 is accommodated in the groove 126 and partially protrudes from the groove 126. One end of the actuating member 131 is fixedly connected to the handling portion 110. The metal actuating member 131 is formed with a chamfer at one end thereof and then is formed integrally with the plastic handling portion 110 by injection molding. It may be appreciated that the actuating member 131 may also be fixedly connected to the handling portion 110 by other means. The other end of the actuating member 131 is accommodated in the hole 125. When the connection between the auxiliary handle 100 and the housing 210 is not yet locked, the locking member 132 contacts the third engaging portion of the housing 210 without pressure. In this embodiment, the third engaging portion 213 is a portion of the housing 210. The handling portion 110 is operated so that the actuating member 131 acts on the locking member 132, and a pressure is generated between the locking member 132 and the third engaging portion 213 of the housing. Then, the clamping members 121 and 122 moves away from the housing, and the space between the clamping members 121, 122 and the projection 214 is reduced, thus the clamping members 121, 122 of the fixing portion 120 and the projection 214 of the housing are locked with each other. The hole 125 is at least partially provided with internal threads 127, and the actuating member 131 is provided with external threads 1311 for engaging with the internal threads 127. The actuating member 131 fixed to the handling portion 110 is rotated by rotating the handling portion 110, and under the action of the threads, the actuating member 131 moves relative to the fixing portion 120 along the main extending axis Y. The actuating member 131 is further provided with a circumferential inclined surface 1312 for cooperating with the locking member 132. When the handling portion 110 is rotated to move the actuating member 131 along the main extending axis Y till the inclined surface 1312 contacts the locking member 132, the locking member 132 is stopped by the third engaging portion 213 of the housing, thus the locking member 132 may be pressed upwards and downwards. Since there is a space between the clamping members 121, 122 and the projection 214, and the actuating member 131 is rigidly connected to the fixing portion 120, as a result, an upward component force is generated when the locking member 132 is under pressure. The component force is transmitted to the actuating member 131, and then transmitted to the fixing portion 120 from the actuating member 131. Thus, the clamping members 121 and 122 move away from the housing, and the space between the clamping members 121, 122 and the projection 124 is decreased. The larger the force for rotating the handling portion 110, the larger the force for lifting the fixing portion 120, thus, the fixing portion 120 is tightly clamped on the housing 210 so that the auxiliary handle 100 is fixed. Contrarily, when the handling portion 110 is rotated to disengage the inclined surface 1312 of the actuating member 131 from the locking member 132, the pressure acting on the locking member 132 is decreased, and the space between the clamping members 121 and 122 of the fixing portion 120 and the projection 214 of the housing is increased, thereby releasing the auxiliary handle 100. The hole 125 is a through-hole, and the other end of the actuating member 131 is provided with a retainer 133 and a collar 134 which cooperate with the stepped surface in the hole 125 so as to prevent the actuating member 131 from disengaging from the fixing portion 120.

Figure 5:
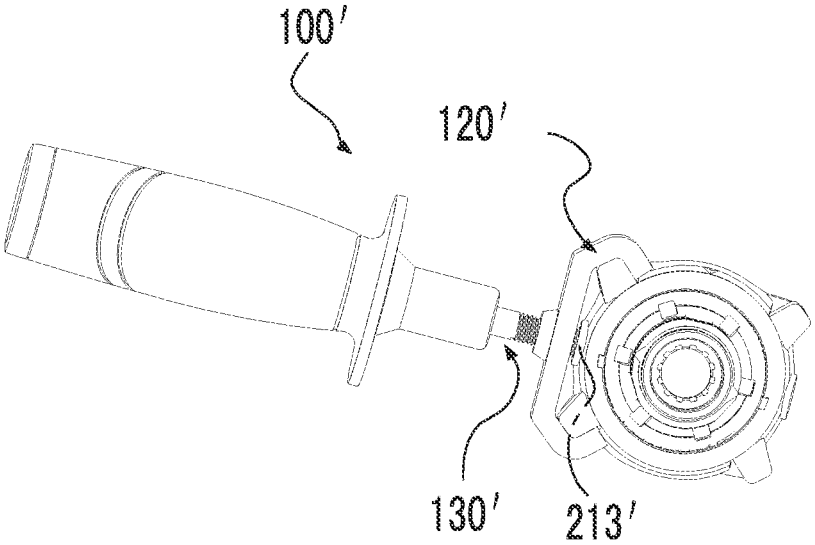
FIG. 5 is also a schematic view showing an exemplary connection between an auxiliary handle and an electric tool according to the description which follows.
Figure 6:
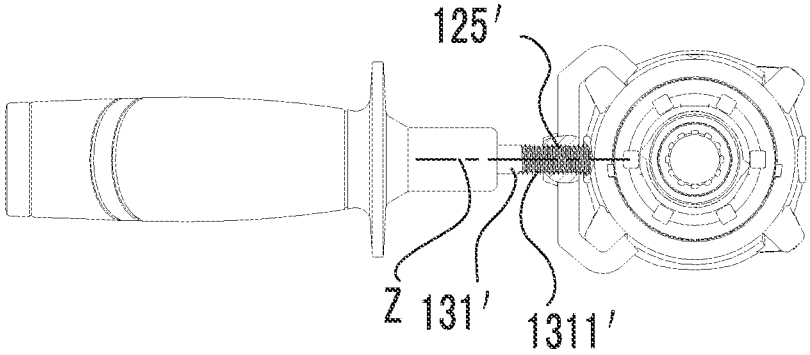
FIG. 6 is a partial sectional view of FIG. 5.

FIGS. 5-6 illustrate an auxiliary handle 100' and only the differences are described with respect to handle 100.

The fixing portion 120' is provided with a threaded hole 125' at the central part thereof. The threaded hole 125' has a central axis Z perpendicular to the longitudinal axis X and the main extending axis Y. The locking portion 130' comprises an actuating member 131' with one end fixedly connected to the handling portion and the other end provided with external threads 1311' for engaging with the threaded hole 125'. The fixing portion may be slid along the first engaging portion and the second engaging portion of the housing, and the clamping members are engaged with the spaced grooves, respectively. When the handling portion is rotated so that the external threads 1311' of the actuating member 131' are engaged with the threaded hole 125', the actuating member 131' moves close to or away from the housing along the central axis Z. When the handling portion is rotated to cause the actuating member 131' to move close to the housing till the other end of the actuating member 131' contacts the third engaging portion 213', the other end of the actuating member 131' is stopped and cannot move. But, due to the action of the threads, the actuating member 131' and the fixing portion 120' need to move relative to each other. At that moment, the clamping members move away from the housing under the action of the threads, thus the space between the clamping members and the projection of the housing is reduced. The larger the force for rotating the handling portion, the smaller the space between the clamping members and the projection of the housing. Thus, the fixing portion may be tightly clamped on the housing, thereby fixing the auxiliary handle 100'. Contrarily, when the handling portion is rotated to move the actuating member 131' away from the housing, the force acting on the clamping members is decreased, and the space between the clamping members of the fixing portion and the projection of the housing is increased, thereby releasing the auxiliary handle 100'. The threaded hole 125' may also be arranged on a separated member connected to the fixing portion 120', and a standard nut member for example may be selected to be fixedly connected to the fixing portion 120'.

It may be appreciated that the third engaging portion may also be a separated member arranged on the housing, such as a boss, preferably formed by a material having high wear resistance, fixed on the housing by welding or clamping, or may be integrally formed with the housing. The third engaging portion has an inner surface into which the other end of the locking member or the actuating member is fitted.

The fixing portion of the auxiliary handle for the electric tool is engaged with the first engaging portion and the second engaging portion distributed circumferentially around the longitudinal axis of the housing, thus the connection therebetween is reliable. The auxiliary handle only encircles a portion of the circumference of the housing, and does not need to pass through the head portion of the housing, thereby reducing the axial size of the whole tool. The locking portion may cooperate with the third engaging portion so as to lock the auxiliary handle by operating the handling portion, thus simplifying the operation. Moreover, the first engaging portion and the second engaging portion may be arranged on any position in the circumferential direction and may also have a plurality of positions, thus the user may fix the auxiliary handle on desired positions according to the specific requirements.

The specific examples described above are only intended to illustrate the ideas and principles of the present invention model, not to restrict the contents of the present invention. Those having ordinary skill in the art can appreciate that besides the above preferred examples, the invention may also include many other alternative or modified embodiments, which are intended to still fall within the scope of the invention that is claimed. The protection scope of the utility model may be defined by the attached claims.

What is claimed is:

1. An auxiliary handle for an electric tool comprising a housing having a first engaging portion, a second engaging portion, and a third engaging portion, the auxiliary handle comprising:

a handling portion;

a fixing portion; and a locking portion, wherein the handling portion enables a user to handle the auxiliary handle and operate the locking portion, wherein the fixing portion is adapted to engage with the first engaging portion and the second engaging portion so as to removably connect the auxiliary handle to the housing, the locking portion is adapted to interact with the third engaging portion so as to lock the auxiliary handle, the locking portion comprises an actuating member fixedly connected to the handling portion and a locking member at least partially accommodated in the fixing portion, and the handling portion is operated so that the actuating member acts on the locking member whereupon a pressure is generated between the locking member and the third engaging portion of the housing to lock the fixing portion and the housing, and the actuating member is rod-shaped and the locking member is a steel ball, and the fixing portion is generally U-shaped and has a main extending axis and two clamping members extending generally perpendicular to the main extending axis, the clamping members being engaged with the first engaging portion and the second engaging portion of the housing respectively, the fixing portion having a hole along the main extending axis and a groove facing the housing and communicated with the hole, the locking member being accommodated in the groove and partially protruding from the groove, and the actuating member having one end fixedly connected to the handling portion and the other end accommodated in the hole.

2. The auxiliary handle for an electric tool according to claim 1, wherein the housing has a longitudinal axis, and the first engaging portion and the second engaging portion are distributed circumferentially around the longitudinal axis, and wherein the auxiliary handle is engageable with the first engaging portion and the second engaging portion in a direction substantially perpendicular to the longitudinal axis, and the first engaging portion and the second engaging portion are grooves formed on the housing, and the grooves are distributed uniformly and circumferentially around the longitudinal axis.

3. The auxiliary handle for an electric tool according to claim 1, wherein the hole is at least partially provided with internal threads, and the actuating member is provided with external threads for engaging with the internal threads and a circumferential inclined surface for interacting with the locking member.

4. The auxiliary handle for an electric tool according to claim 1, wherein the housing has a longitudinal axis, the hole of the fixing portion is a threaded hole at a center of the fixing portion and has a central axis perpendicular to the longitudinal axis and the main extending axis, and the other end of the actuating member is provided with external threads for engaging with the threaded hole.

5. The auxiliary handle for an electric tool according to claim 1, wherein the third engaging portion is arranged between the first engaging portion and the second engaging portion and is one of a portion of the housing and a boss arranged on the housing, wherein the boss is made of a material having high wear resistance and has an inner surface for engaging with one end of the actuating member.

6. An electric tool, comprising:

a housing;

a motor arranged in the housing;

a transmission mechanism driven by the motor;

a working head driven by the transmission mechanism;

a main handle extending from the housing; and an auxiliary handle removably fixed on the housing, the auxiliary handle comprising:

a handling portion, a fixing portion and a locking portion, the handling portion enabling the user to handle the auxiliary handle and operate the locking portion, wherein the housing has a first engaging portion, a second engaging portion, and a third engaging portion arranged between the first engaging portion and the second engaging portion, the fixing portion being engaged with the first engaging portion and the second engaging portion so as to connect the auxiliary handle to the housing, and the locking portion interacting with the third engaging portion so as to lock the auxiliary handle, the locking portion comprises an actuating member fixedly connected to the handling portion and a locking member at least partially accommodated in the fixing portion, and the handling portion is operated to enable the actuating member to act on the locking member so that a pressure is generated between the locking member and the third engaging portion of the housing to lock the fixing portion and the housing, and wherein the actuating member is rod-shaped and the locking member is a steel ball, and the fixing portion is generally U-shaped and has a main extending axis and two clamping members extending generally perpendicular to the main extending axis, the clamping members being engaged with the first engaging portion and the second engaging portion of the housing respectively, the fixing portion having a hole along the main extending axis and a groove facing the housing and communicated with the hole, the locking member being accommodated in the groove and partially protruding from the groove, and the actuating member having one end fixedly connected to the handling portion and the other end accommodated in the hole.

7. The electric tool according to claim 6, wherein the housing has a longitudinal axis, and the first engaging portion and the second engaging portion are distributed circumferentially around the longitudinal axis, and wherein the auxiliary handle is engageable with the first engaging portion and the second engaging portion in a direction substantially perpendicular to the longitudinal axis, and the first engaging portion and the second engaging portion are grooves formed on the housing, the grooves being distributed uniformly and circumferentially around the longitudinal axis.

8. The electric tool according to claim 6, wherein the housing has a longitudinal axis, the hole of the fixing portion is a threaded hole at a center of the fixing portion and has a central axis perpendicular to the longitudinal axis and the main extending axis, and the other end of the actuating member is provided with external threads for engaging with the threaded hole.

* * * * *